US005681399A

United States Patent [19]

Okano

[11] Patent Number: 5,681,399

[45] Date of Patent: Oct. 28, 1997

[54] METHOD OF REMOVING SMEAR OR STAIN FROM A COATED SURFACE WITH AN AQUEOUS DISPERSION OF A HIGHLY ABSORBENT POLYMER

[75] Inventor: Ikuo Okano, Choshi, Japan

[73] Assignee: Creor Corporation, Chiba-ken, Japan

[21] Appl. No.: 540,738

[22] Filed: Oct. 11, 1995

[30] Foreign Application Priority Data

Oct. 17, 1994 [JP] Japan ..... 6-277030

[51] Int. Cl.[6] ..... B08B 7/00; B08B 3/02

[52] U.S. Cl. ..... 134/4; 134/34; 427/155; 510/197; 510/241; 510/403; 510/475

[58] Field of Search ..... 134/4, 34; 427/155, 427/154, 353; 510/241, 197, 474, 475, 476, 403

[56] References Cited

U.S. PATENT DOCUMENTS

| | | | |
|---|---|---|---|
| 3,728,267 | 4/1973 | Hirota et al. | 134/4 X |
| 3,746,577 | 7/1973 | Copeland | 134/4 X |
| 4,157,921 | 6/1979 | Baturay et al. | 134/4 |
| 4,200,671 | 4/1980 | Krajewski et al. | 134/4 |
| 5,017,237 | 5/1991 | Svensson | 427/155 X |
| 5,143,949 | 9/1992 | Grogan et al. | 427/154 X |
| 5,330,788 | 7/1994 | Roberts | 427/154 |
| 5,505,787 | 4/1996 | Yamaguchi | 134/4 |

FOREIGN PATENT DOCUMENTS

| | | |
|---|---|---|
| 64-90851 | 4/1989 | Japan . |
| 2-114040 | 4/1990 | Japan . |

*Primary Examiner*—Jeffrey Snay
*Assistant Examiner*—Saeed Chaudhry
*Attorney, Agent, or Firm*—Panitch Schwarze Jacobs & Nadel, P.C.

[57] ABSTRACT

A method is disclosed for removing smearing material or filth deposits from a coated surface by means of spraying an aqueous dispersion to form a gel-like film on the surface. The aqueous dispersion comprises a selected amount of highly absorbent and/or water-soluble polymers dispersed in water. The gel-like film is washed down with pressured water with smearing particulate material entrained therewith.

4 Claims, No Drawings

METHOD OF REMOVING SMEAR OR STAIN FROM A COATED SURFACE WITH AN AQUEOUS DISPERSION OF A HIGHLY ABSORBENT POLYMER

BACKGROUND OF THE INVENTION

1. Field of the Invention

This invention relates to a method of cleaning coated surfaces of various substrates such as of automobiles, railroad vehicles, aircrafts and the like, more particularly such a cleaning method which is capable of removing objectionable inorganic particulate materials firmly deposited on substrates covered with ornamental or protective coatings.

2. Prior Art

Coated surfaces of for example an automobile are susceptible to smear by deposits of incomplete combustion material from the exhaust pipe, dirt on the road, soot floating in the air, fine coal tar or asphalt granules flying off the pavement and other foreign matters. Such deposits would be often tenaciously stuck in place over a few days to leave a smear or stain such that can hardly be removed by simple washing with water. Most typical means for removing such smear was to apply some surfactant-containing alkaline cleanser and rub the smeared surfaces by hand or tool like a car washer, followed by washing down with water. Thus, smear removal was essentially relied upon "rubbing", less upon the efficacy of jet-sprayed water or cleaning liquor having a dissolving or emulsifying ability, as such abilities would not work effectively with dirt-origin inorganic particulate substances. Smear deposits were believed to be attributable to static or intermolecular force (van der Waals force). Whatever the cause might be, experience has shown that smear on coated surfaces could not be got rid of simply by blasting water or cleaner agent. Again, "rubbing" was considered essential for complete cleaning of smear or stain on coating layers, whether it be tediously by hand or a scratch-risking machine.

Japanese Laid-Open Patent Publication No. 64-90851 discloses applying over smeared surfaces an alkaline cleaning liquor having a pH of 10 or above and containing a surface-active agent, and immediately blasting the surfaces with a high jet (above 30 kg/cm$^2$ discharge pressure) of water dispersed with less than 2 Mohs particles or a surfactant solution.

Japanese Laid-Open Patent Publication No. 2-114040 teaches a blasting method in which water dispersed with 1–30 percent by weight of particulate material about 1 Mohs and about 10–30 microns in particle size is blasted at 30 kg/cm$^2$ over stained coated surfaces.

Neither of the above prior methods is satisfactory in that particulate material, should this even be soft, when blasted will fiercely impinge upon and scratch the coated surface layer.

SUMMARY OF THE INVENTION

With the foregoing drawbacks of the prior art in view, the present invention seeks to provide a method of removing smear or stain from a coated surface solely by means of coating or spraying a selected cleaning agent without resort to conventional rubbing or blasting with particulate material.

More specifically, the invention provides an improved method which comprises forming a gel-like film over a smeared coated surface, the film being comprised of an aqueous dispersion containing 0.01–10 parts by weight of a highly absorbent polymer and/or a water-soluble polymer per 1000 parts by weight of water, and subsequently washing down the film together with smearing material deposited on the surface with a flow of water sprayed under a pressure of above 5 kg/cm$^2$.

DETAILED DESCRIPTION OF THE INVENTION

It has now been found that an aqueous dispersion containing a highly absorbent or water-soluble polymer contemplated under the invention forms a gel-like film layer such that can absorb smearing material, typically inorganic particles, with a greater affinity than that with which such material is absorbed onto a coated surface and consequently can be washed down entraining the material. Importantly, the dispersion should have a viscosity such that will enable the same to form and maintain a gel-like film even on vertically disposed substrate surfaces to be cleaned and such that will permit the use of a spray nozzle with which to conveniently apply the dispersion to polygonal or otherwise complicated surface configurations.

The term highly absorbent polymer as used herein designates cross-linked products of an alkaline metal polyacrylate (typically sodium salts), starch-acrylic acid graft copolymers, hydrolyzates of starch-acrylonitrile graft copolymers, saponification products of vinylacetate-acrylic acid copolymers, acrylamide-acrylate copolymers, saponification products of vinylacetate-maleic anhydride copolymers, cross-linked products of polyethylene oxide, and polysaccharide-acrylic acid graft copolymers.

The term water-soluble polymer as used herein includes those which have a weight average molecular weight of above 10,000 such as an alkaline metal alginate, methylcellulose, carboxy-methylcellulose, alkaline metal polyacrylate (typically sodium salts), and polyethylene oxide.

The highly absorbent polymer and/or water-soluble polymer may be dispersed in water suitably by means of a high-shear mixer.

The inventive aqueous dispersion may be added, if desired, with nonionic, anionic, cationic as well as amphoteric cleaning surfactants. In the case of nonionic surfactants, these should have an HLB value preferably in the range of 10–15. There may also be used such additives as glycol ether solvents, metallic ion hindering agents, and the like.

The invention will be further described by way of the following examples.

PREPARATION OF TEST PANEL

Steel plate substrates measuring 30 cm×30 cm were coated with a black aminoalkyd resin coating and completely dried, followed by degreasing with kerosine and washing with a neutral cleanser. The thus coated substrates, after being dried, were coated uniformly with a silt aqueous dispersion and then dried at 50° C. over 24 hours thereby providing Test Panel X.

Another set of the above coated substrates were coated with a car-wax and polished with a towel, followed by spraying the same silt dispersion. This spraying if only once would leave just sparsely distributed silt because of the presence of wax on the substrate. Therefore, the dispersion was sprayed repeatedly with alternate wind blowing until the silt was deposited uniformly over the entire coated substrate surface. Thereafter, the substrates were dried at 50° C. over 24 hours to provide Test Panel Y.

PREPARATION OF CLEANING LIQUOR

A set of cleaning liquors were prepared from the following formulations.

| | |
|---|---|
| Cleaning Liquor A | |
| Drinking water | 1,000 cc |
| Partially cross-linked product of sodium polyacrylate | 4 g |
| Cleaning Liquor B | |
| Drinking water | 1,000 cc |
| Sodium alginate | 8 g |
| Cleaning Liquor C | |
| Drinking water | 1,000 cc |
| Partially cross-linked product of sodium polyacrylate | 4 g |
| Hepta-sodium salt of diethylene triamine penta(methylene phosphonic acid | 6 g |
| Dipropyleneglycol monomethyl ether | 12 g |
| Polyoxyethylene tridecyl ether (HLB = 10.5) | 6 g |
| Cleaning Liquor D | |
| Drinking water | 1,000 cc |
| Sodium hexametaphosphate | 8 g |
| Sodium dioctyl sulfosuccinate | 2 g |
| Polyoxyethylene nonylphenyl ether (HLB = 10.5) | 12 g |
| Diethyleneglycol monomethyl ether | 10 g |
| Cleaning Liquor E | |
| Drinking water | 1,000 cc |
| Polyoxyethylene nonylphenyl ether | 12 g |
| Sodium polyoxyethylene tridecyl ether sulfate | 6 g |
| Dioctylsulfo succinic acid ester Na salt | 2 g |
| Cleaning Liquor F | |
| Drinking water | 1,000 cc |
| Sodium carboxylmethyl cellulose (300,000 molecular weight) | 4 g |
| Polyoxyethylene nonylphenyl ether (HLB = 12.9) | 10 cc |
| Polyoxyethylene nonylphenyl ether (HLB = 10.0) | 5 cc |
| Hydroxyethylidene trisodium diphosphonate | 2 g |
| Cleaning Liquor G | |
| Drinking water | 1,000 cc |
| Partially cross-linked product of potassium polyacrylate | 4 g |
| Polyoxyethylene nonylphenyl ether (HLB = 12.9) | 10 cc |
| Polyoxyethylene nonylphenyl ether (HLB = 10.0) | 5 cc |
| Tri-sodium salt of 1-hydroxyethylidene-1,1-diphosphonic acid | 2 g |
| Cleaning Liquor H | |
| Drinking water | 1,000 cc |
| Cross-linked product of starch-acrylate graft copolymer | 4 g |
| Polyoxyethylene nonylphenyl ether (HLB = 12.9) | 10 cc |
| Polyoxyethylene nonylphenyl ether (HLB = 10.0) | 5 cc |
| Tri-sodium salt of 1-hydroxyethylidene-1,1-diphosphonic acid | 2 g |

EXAMPLE 1

Eight pieces of Test Panel X were each sprayed with Cleaning Liquors A–H, respectively and then after a lapse of 5 minutes, washed down with water pressured at 30 kg/cm$^2$. After being dried, each Panel was visually observed for the extent to which the silt had been removed from its coated surface, with the results shown in Table 1.

TABLE 1

| Cleaning Liquor | A | B | C | D | E | F | G | H |
|---|---|---|---|---|---|---|---|---|
| Silt Removed | O | O | O | X | X | O | O | O |

Note:
O indicates complete removal of silt.
X indicates the presence of silt residues.

EXAMPLE 2

Six pieces of Test Panel Y were each sprayed with Cleaning Liquors C–H. After a lapse of 5 minutes, each Panel was washed down with a spray of water pressured at 30 kg/cm$^2$ and then dried. Visual test was made for silt removal with the results shown in Table 2.

TABLE 2

| Cleaning Liquor | C | D | E | F | G | H |
|---|---|---|---|---|---|---|
| Silt Removed | O | X | X | O | O | O |

EXAMPLE 3

Another six pieces of Test Panel Y were each sprayed with Cleaning Liquors C–H, respectively, at a jet pressure of 30 kg/cm$^2$, followed by washing down the liquors with a spray of water pressured at 30 kg/cm$^2$. After being dried, each Panel was visually observed for silt removal with the results shown in Table 3.

TABLE 3

| Cleaning Liquor | C | D | E | F | G | H |
|---|---|---|---|---|---|---|
| Silt Removed | O | X | X | O | O | O |

What is claimed is:

1. A method of removing smear or stain from a coated surface which comprises the steps of forming a film over a smeared coated surface, said film being comprised of an aqueous dispersion containing 0.01–10 parts by weight of a highly absorbent polymer per 1,000 parts by weight of water, and subsequently washing down said film together with smearing material deposited on said coated surface with a spray of water pressured at above 5 kg/cm$^2$.

2. The method according to claim 1 wherein said highly absorbent polymer is selected from the group consisting of cross-linked products of an alkaline metal polyacrylate, starch-acrylic acid graft copolymers, hydrolyzates of starch-acrylonitrile graft copolymers, saponification products of vinylacetate-acrylic acid copolymers, acrylamide-acrylate copolymers, saponification products of vinylacetate-maleic anhydride copolymers, cross-linked products of polyethylene oxide, and polysaccharide-acrylic acid graft copolymers.

3. The method according to claim 2, wherein the alkaline metal polyacrylate comprises a sodium polyacrylate.

4. The method according to claim 1 wherein said aqueous dispersion further comprises at least one of nonionic surfactants, anionic surfactants, cationic surfactants, and amphoteric surfactants.

* * * * *